United States Patent [19]

Ishizuka

[11] 4,164,828

[45] Aug. 21, 1979

[54] ABRASIVE MACHINE FOR STONES

[76] Inventor: Hiroshi Ishizuka, 19-2 Ebara 6-chome, Shinagawa-ku, Tokyo, Japan

[21] Appl. No.: 860,630

[22] Filed: Dec. 14, 1977

Related U.S. Application Data

[63] Continuation of Ser. No. 698,959, Jun. 23, 1976, abandoned.

[30] Foreign Application Priority Data

Jun. 26, 1975 [JP] Japan ..... 50/80234

[51] Int. Cl.[2] ..... B24B 7/22

[52] U.S. Cl. ..... 51/110; 51/120

[58] Field of Search ..... 51/110, 119, 120; 125/3, 9

[56] References Cited

U.S. PATENT DOCUMENTS

| | | | |
|---|---|---|---|
| 1,233,120 | 7/1917 | Patch | 51/120 X |
| 1,375,129 | 4/1921 | Carrie | 51/110 |
| 1,538,463 | 5/1925 | Carrie | 51/120 |
| 1,893,985 | 1/1933 | Cruikshank | 51/120 X |
| 2,865,142 | 12/1958 | Dunipace | 51/120 |
| 3,874,123 | 4/1975 | Hopkins | 51/120 |

*Primary Examiner*—Nicholas P. Godici

*Attorney, Agent, or Firm*—Birch, Stewart Kolasch & Birch

[57] ABSTRACT

An abrasive machine for stones, which comprises one or more abrasive units and means for feeding the stones, each of said units having a plurality of abrasive tools each provided with a grindstone rotatably mounted thereto, said abrasive tools being arranged and driven along a circular line, whereby each of said grindstones not only rotates but also revolve to grind and polish the stone surface contact therewith.

3 Claims, 4 Drawing Figures

ABRASIVE MACHINE FOR STONES

This application is a continuation of copending application Ser. No. 698,959, filed on June 23, 1976 now abandoned.

BACKGROUND OF THE INVENTION

1. Field of the Invention

The present invention relates to an abrasive machine for stones, and more particularly to such machine for grinding-polishing a flat stone surface with the flat surface of a circular rotary abrasive disk tool of which the vertical position is made adjustable in relation to the stone surface.

Various kinds of stones such as marble, granite and the like have been used for various purposes. Depending on the purposes or uses, a fairly large area of stone plate is subjected to grinding and polishing at the exterior side thereof, e.g. for flooring, wall construction and the like.

2. Description of the Prior Art

Hitherto, the abrasion or grinding-polishing of such stone work-piece has been carried out by grinding the stone surface with the flat surface of a circular rotating disk grindstone made of an abrasive material such as particles or chips of natural or synthetic diamond, carborundum or the like and a suitable binder. Such grindstone is detachably mounted on a disk head adapted to be rotated and manually moved over the stone surface. As the polishing progresses, such grindstone is exchanged with a finer grindstone one after another, and finally with a felt for polishing or finishing the stone surface with aid of finely pulverized abrasive material.

In order to avoid troublesome exchange of the grindstone and make the abrasion working efficient, it is possible to arrange a plurality of such grinding machines in series so as to process the work-piece from rough grinding, according to the first machine, to final polishing, according to the last machine. It is inevitable, however, that undulations or uneveness are present on the processed work-piece surface when the stone plate is of fairly large area relative to the dimension of the abrasive tool. This is a result of a suitable width of the stone plate being subjected to grinding by manually driving the rotating abrasive tool to-and-fro over the stone plate surface, and when such area has been treated the work-piece is moved so as to further process a new area of the stone plate. Considerable skill is required for driving such abrasive tool without causing such unevenness. In order to avoid such undersired undulation and make the abrasion working more efficient, it has been considered to enlarge the diameter of the disk grindstone as large as possible. It will be readily understood, however, that there is naturally a limitation in doing so because of the mechanical strength of the formed grindstone on the one hand and of rattling of the rotary disk on the other hand.

SUMMARY OF THE INVENTION

According to the present invention, there are circumferentially arranged an assembly of a plurality of rotary abrasive tool disks and the assembly of these rotary abrasive tools is adapted to be rotated so that each abrasive tool is rotatably driven and concurrently the assembly revolves. The work-piece is successively fed so that the surface thereof is subjected to abrasion working of these rotating and revolving abrasive tools during the slow travel of the stone plate. Each grindstone of each of said abrasive tools may be exchanged with a finer one, when the rough grinding has been completed. It is preferable, however, to provide a plurality of such machines in series for proceeding with continous grinding and polishing of the work piece fed through these machines one after another.

A principal object of the present invention is, therefore, to provide an abrasive machine for stones which can obviate and overcome the disadvantages and faults encountered in the conventional machine as referred to above.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
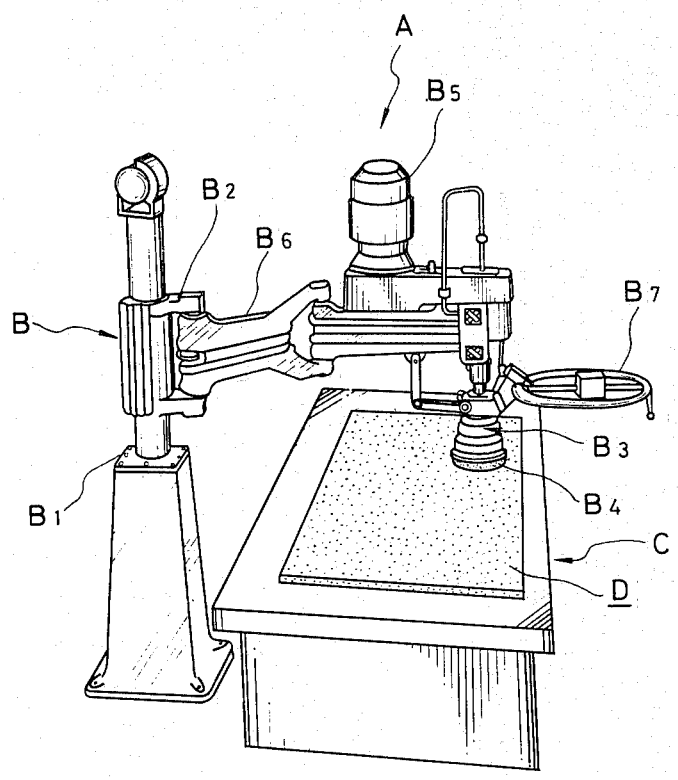
FIG. 1 PRIOR ART
FIG. 1 is a perspective view of a typical conventional abrasive machine.

In FIG. 1, a conventional typical abrasive machine for stones is generally designated by reference symbol A. The machine A has a machine body B and a bench or working table C which is arranged separately from but closely to the machine body B and on which a stone plate D as work-piece is positioned. The machine body B comprises an up-right support $B_1$ having a lower base portion and an upper cylindrical portion, a slidable member $B_2$ fitted on the upper cylindrical portion of the support $B_1$, an abrasive tool $B_3$ detachably mounted with a grindstone or grinding disk $B_4$, an electric motor $B_5$ for rotatably driving the abrasive tool $B_3$ to cause rotation of the grindstone $B_4$, an articularly connected arm member $B_6$, one end of which is pivotally connected to the slidable member $B_2$ to serve as a support for mounting the electric motor $B_5$ and the abrasive tool $B_3$ mounted adjacent the grindstone $B_4$ at the other or free end thereof, and a handle $B_7$ for manually operating the machine.

According to the conventional stone abrasive machine A, a machine operator must first operate the handle $B_7$ to turn the abrasive tool $B_3$ outside the peripheral edge of the table C, so that the work-piece D, which may be manually or mechanically fed, can be set in position on the table C. Then the operator again moves the handle $B_7$ to raise the abrasive tool $B_3$ a little, return and lower the same on the work-piece D, so that the grindstone $B_4$ attached to the lower end of the abrasive tool $B_3$ contacts the outer surface of the work-piece D. In abrasive working operation of the machine A, the operator turns-on a switch (not shown) to actuate the electric motor $B_5$ to cause rotation of the abrasive tool $B_3$ and consequently the grindstone $B_4$ attached thereto and, at the same time, operates the handle $B_7$ to horizontally move the abrasive tool $B_3$ on the surface of the work-piece D to-and-fro to grind and polish the same.

Figure 2:
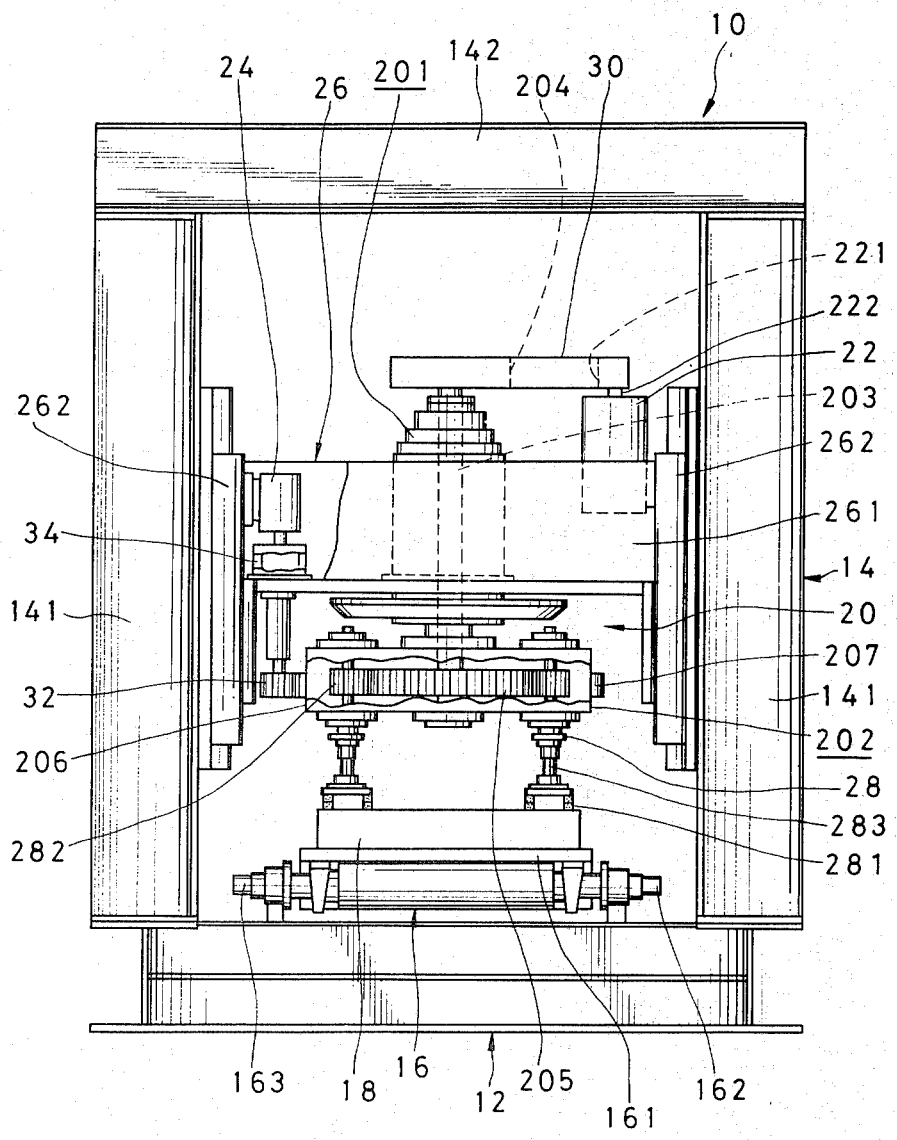
FIG. 2 is a vertical side view of an abrasive machine according to the present invention, some parts thereof being shown in fragment or section.
Figure 3:
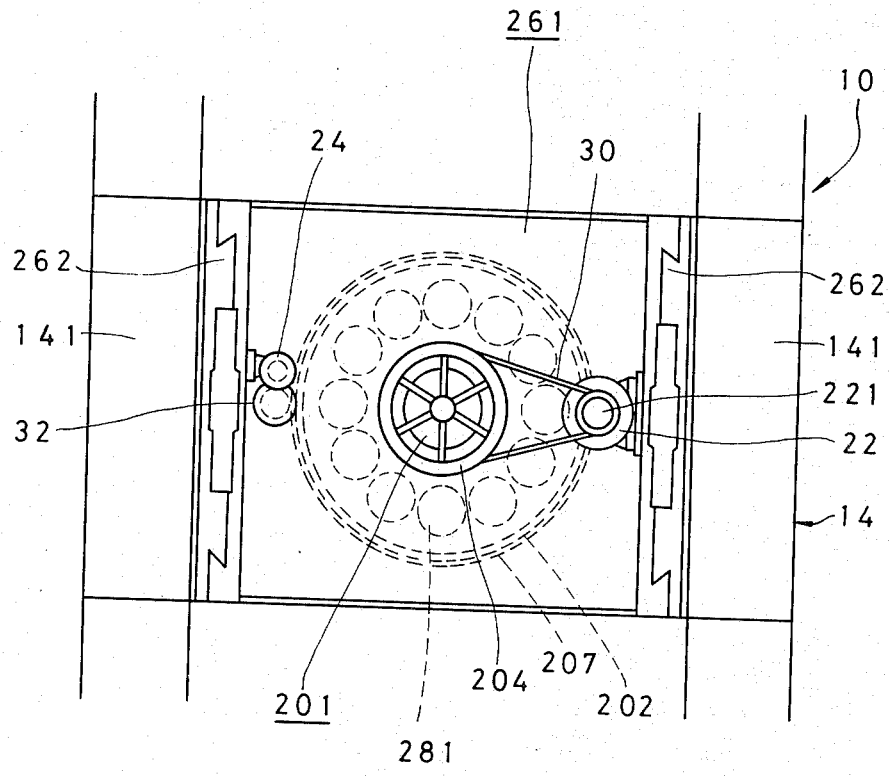
FIG. 3 is a diagrammatic top plan view of the machine as illustrated in FIG. 2 which shows an arrangement of grindstones and mechanisms for causing rotation and revolution of each grindstone.

FIGS. 2 and 3 illustrate an embodiment of an abrasive machine according to the present invention. The machine as generally designated by reference numeral 10 comprises a base 12, a frame structure 14 mounted on the base 12 and having two vertical side frames 141,141 and a horizontal top frame 142, a mechanism 16 arranged on the base 12 to feed a stone plate 18 as the work-piece, an abrasion unit 20 arranged above the feeding mechanism 16 and between the side frames 141,141 of the frame structure 14, electric motors 22, 24 for actuating the abrasion unit 20, and means 26 for supporting the abrasion unit 20.

The work-piece feeding mechanism 16 may be a roller conveyor, as illustrated, or a chain conveyor, belt conveyor or the like but it is preferable to arrange thereon a flat metal or wood plate 161 as a carrier, so that the work-piece can be horizontally and stably held thereon. The conveyor may be actuated by an electric motor (not shown), an output shaft of which is connected to a shaft end 162 of one of the rollers through suitable reduction gearings (not shown). The other shaft end 163 is connected to corresponding shaft end of the other rollers through an endless belt or other transmission means (not shown) to form the roller conveyor as the work-piece feeding mechanism 16. The abrasion unit 20 has a head portion 201 carried by the supporting means 26 and a leg portion 202 which comprises a plurality of abrasive tools 28 arranged along a circle around a central vertical axis of the abrasion unit 20, each of said abrasive tools 28 having a grindstone or grinding disk 281 which was made of abrasive material such as synthetic diamond particles or chips and binder. According to the abrasive machine 10 of the present invention, each of the grindstones 281 can be not only rotated but also revolved and thus it is not always necessary to increase the diameter of each grindstone 281 correspondingly increase the abrasion working efficiency of the machine. This makes the production and handling of the grindstone 281 quite easy. The abrasion unit supporting means 26 comprises a box-like member 261 for carrying the abrasion unit 20 and a slidable means 262,262, each of which may be secured to the box member 261 at one side and secured on the inner surface of the vertical side frame 141 of the frame structure 14 at the other side.

In operation of the machine 10 as shown in FIGS. 2 and 3, a machine operator turns-on a switch (not shown) to actuate the electric motors 22 and 24. An output of the motor 22 is transmitted to a main shaft 203 of the abrasion unit 20 through a pulley 221 mounted on an output shaft 222 of the motor 22, another pulley 204 mounted on the main shaft 203 at one end thereof and an endless belt 30 for mechanically connecting the pulleys 221 and 204, to cause rotation of a main gear 205 mounted on the main shaft 203 at the other end. Each of a plurality of small gears 282 for the abrasive tools 28 meshes with the main gear 205 so as to be rotatably driven by the main gear 205. The rotation of each small gear 282 causes rotation of the corresponding grindstone or grinding disk 281 attached to the lower end of a shaft 283 of each abrasive tool 28, on which the small gear 282 is securely mounted. A hollow cylindrical housing 206 for accommodating the main gear 205, small gears 282 and maintaining the shafts 283 of the abrasive tools 28 in position has a rack 207 on an outer peripheral surface thereof. The rack 207 meshes with a pinion 32 rotatingly driven by the electric motor 24 through a coupling means 34, to cause revolution of each abrasive tools 28 and more particularly each rotary grindstone 281. The work-piece 18 can continuously be fed by the work-piece feeding mechanism 16, as stated hereinbefore, to grind and/or polish the outer surface of the work-piece 18 by the rotating and revolving grindstones 281.

The level of the abrasion unit 20 and more particularly the gap or distance between the lower end surface of the grindstones 281 and the upper surface of the work-piece 18 can be adjusted by operating the slidable means 262, depending on the thickness of work-piece to be treated.

The grindstones 281 for each abrasion unit 20 may be same or different in roughness. The roughness of the grindstones 281 may be selected depending on surface characteristics and the type of work-piece 18 to be treated.

The abrasive machine 10 according to the present invention may be modified to a continuous abrasive machine, by subsequently feeding the work-pieces 18 therein with the aid of the feeding mechanism 16 and by arranging a plurality of abrasive units 20 in series so that roughness of the grindstones of the respective unit are made gradually finer. According to such a machine, the work-pieces can continuously be worked from rough grinding to polishing or finishing, whereby the working ability can considerably be improved in comparison with any conventional machine.

Figure 4:
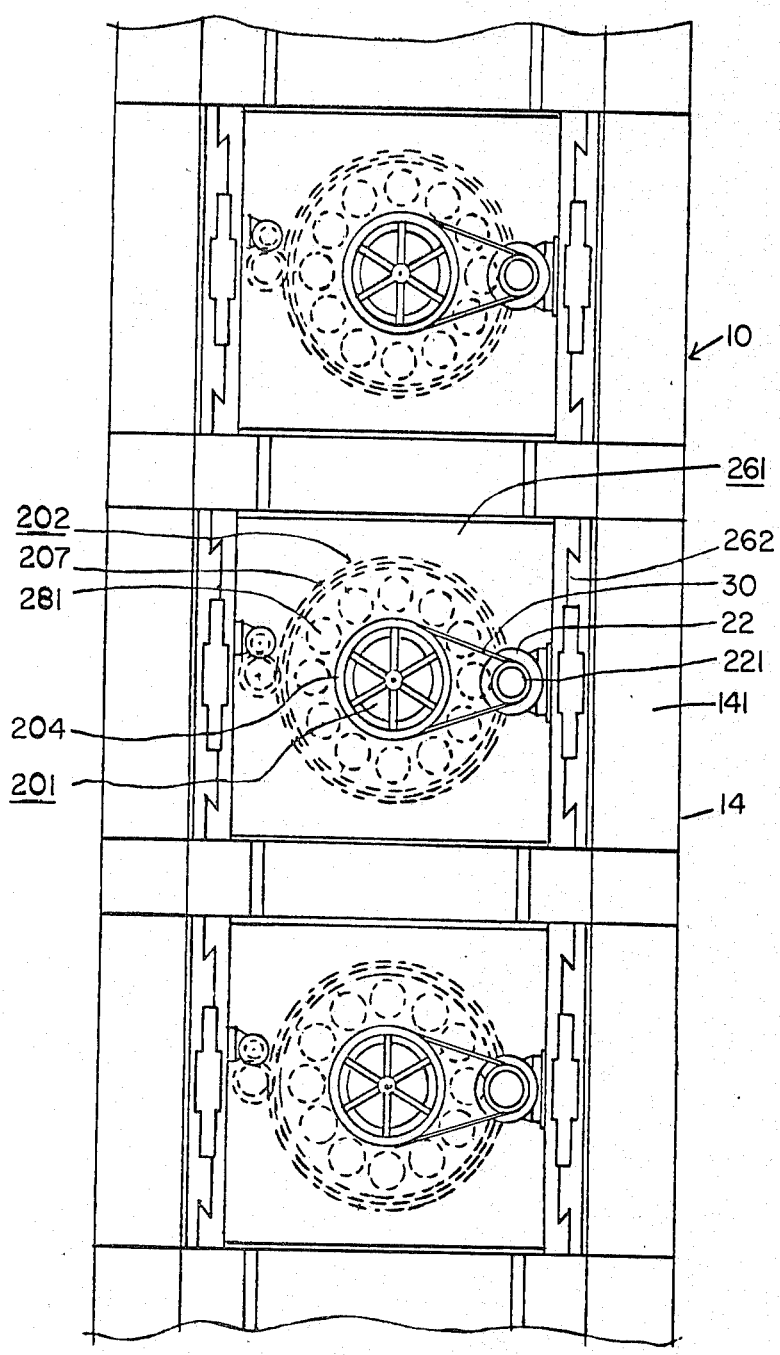
FIG. 4 is a plan view of a plurality of machines of the present invention in series.

FIG. 4 is a plan view of a plurality of machines of the present invention in series. The numerals in FIG. 4 are similar to those shown in FIG. 3 and will not be further discussed.

The invention will now be further explained with reference to an example showing the grinding-polishing ability of the continuous abrasive machine according to the present invention.

EXAMPLE

A plurality of cut plates (width: 60 cm) of granite from Paochon (Korea) were subsequently fed into the following abrasive machine at feeding velocity of 1.5 m/min. which means the working area is 54 $m^2$/hr., to continuously grind and polish one side surface of the stone plate.

Abrasive Machine

The abrasive machine used was substantially the same as the one illustrated in FIGS. 2 and 3 and had following measures.

Number of abrasive units: 15

Number of abrasive tools or grindstones for each unit: 12

Diameter of each grindstone: 12 cm

Abrasive material for each grindstone (except for the final unit which uses a conventional felt for buffing): synthetic diamond particle or chip Particle size of abrasive material for grindstones:

For 1st and 2nd abrasive units: 40 to 50 meshes (metal bonded)

For 3rd and 4th abrasive units: 60 to 80 meshes (metal bonded)

For 5th and 6th abrasive units: 100 to 120 meshes (metal bonded)

For 7th and 8th abrasive units: 170 to 200 meshes (metal bonded)

For 9th and 10th abrasive units: 170 to 200 meshes (resin bonded)

For 11th and 12th abrasive units: 12 to 25μ (resin bonded)

For 13th and 14th abrasive units: 4 to 8μ (resin bonded)

The stone plates were ground by a thickness of 1.0 mm when they had been passed through the second abrasive unit and the thickness of each plate was finally reduced by 3.0 mm. The surface of each worked plate showed a very high flatness and very fine burnish.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. An abrasive machine for grinding a work-piece comprising:

a base member;

a frame structure including a pair of vertical side members and a top member securely mounted on top ends of the vertical side members;

said frame structure being mounted on said base member;

means arranged above said base member for feeding a work-piece;

at least one abrasion unit which is positioned above the feeding means and comprises:

(i) a first housing supported between the vertical side members and in sliding contact therewith for adjusting the height of the first housing;

(ii) a central axis member extending through the first housing and being substantially parallel to the vertical side members, having one end connected to an output shaft of a first motor through a transmission means and having the other end securely connected to a main gear;

(iii) said central axis, first motor and transmission means being mounted on said first housing;

(iv) a second housing which encases the main gear and a plurality of smaller gears arranged in mesh and concentric with the main gear, each of said plurality of smaller gears being rotatably mounted on an axle journaled in the second housing, said axles being restricted from longitudinal movement and said second housing includes an annular rack in mesh with a pinion connected to an output shaft of a second motor for revolution of the smaller gears about the central axis of the main gear, each of said smaller gears carrying an abrasive tool with a grindstone detachably mounted thereto and said first and second housings being vertically adjustable as a unit.

2. An abrasive machine as set forth in claim 1, wherein the work-piece is a stone.

3. In an abrasive machine for grinding a work-piece comprising:

a base member;

a frame structure including a pair of vertical side members and a top member securely mounted on top ends of the vertical side members, said frame structure being mounted on said base member;

means arranged above said base member for continuously feeding the work-piece; and a plurality of abrasion units, each of which is positioned above said feeding means, arranged in series and comprising:

(a) a first housing supported between the vertical side members and in sliding contact therewith, so that the height of the first housing can be adjusted;

(b) a central shaft member extending through the first housing substantially parallel to the vertical side members, having one end connected to an output shaft of a first electric motor through a transmission means and having the other end connected securely to a main gear;

(c) a second housing which encases the main gear and a plurality of smaller gears arranged around and in concentrical manner with the main gear to mesh therewith, each of the smaller gears being rotatably mounted on a shaft journaled in the second housing, said second housing having on its outer periphery an annular rack in mesh with a pinion connected to an output shaft of a second electric motor for revolution of the smaller gears about a longitudinal axis of said central shaft; and (d) an abrasive tool carried by each of the smaller gears and having a grindstone which is detachably mounted to a free end thereof in which the abrasive grindstones on each abrasive tool for the same abrasive unit contain synthetic diamond particles of substantially the same size, and such abrasive units are arranged in such a series that a preceding abrasive unit has abrasive tools, each of which tools has diamond particles somewhat larger in size than those on abrasive tools for a subsequent abrasive unit, whereby the stone can continuously be worked from a rough grinding to polish finishing.

* * * * *